US011440034B2

(12) United States Patent
Lubeck et al.

(10) Patent No.: US 11,440,034 B2
(45) Date of Patent: Sep. 13, 2022

(54) SPRAY WAND

(71) Applicants: Gerald M. Lubeck, Spruce Grove (CA); Gordon J. Maginnis, Spruce Grove (CA)

(72) Inventors: Gerald M. Lubeck, Spruce Grove (CA); Gordon J. Maginnis, Spruce Grove (CA)

( * ) Notice: Subject to any disclaimer, the term of this patent is extended or adjusted under 35 U.S.C. 154(b) by 202 days.

(21) Appl. No.: 16/740,055

(22) Filed: Jan. 10, 2020

(65) Prior Publication Data

US 2020/0222925 A1 Jul. 16, 2020

Related U.S. Application Data

(60) Provisional application No. 62/791,351, filed on Jan. 11, 2019.

(51) Int. Cl.
*B05B 7/04* (2006.01)
*B05B 15/68* (2018.01)

(52) U.S. Cl.
CPC ..... *B05B 7/0416* (2013.01); *B05B 15/68* (2018.02)

(58) Field of Classification Search
CPC ..... B05B 7/0416; B05B 15/68; B05B 7/0018; B05B 7/0408; B05B 7/1263; B05B 7/2497; B05B 15/62
USPC ..... 222/637
See application file for complete search history.

(56) References Cited

U.S. PATENT DOCUMENTS 4,915,304 A * 4/1990 Campani ..... B05B 12/0022 239/473
5,058,805 A * 10/1991 Anderson ..... B05B 7/1263 239/3
5,092,265 A * 3/1992 Hughes ..... B05B 3/022 118/317
2003/0127542 A1* 7/2003 Cooper ..... B05B 12/1418 239/548
2005/0023296 A1* 2/2005 Bien ..... B05B 7/166 222/146.1
2005/0035226 A1* 2/2005 Schebesta ..... B05B 7/0884 239/551
2015/0108254 A1* 4/2015 Commette ..... B05B 7/1245 239/428

* cited by examiner

*Primary Examiner* — Vishal Pancholi
(74) *Attorney, Agent, or Firm* — Bennett Jones LLP

(57) ABSTRACT

A plural component spray gun system for use with a reactor having a chemical supply, a heater, a pump and a compressor, includes a trigger module with a spool valve having an air inlet and an activating outlet and an deactivating outlet; and an air body connected to the trigger module by an intermediate extending portion and having a mixing chamber to combine pressurized chemical components upon activation of a piston by pressure from the activating outlet.

4 Claims, 10 Drawing Sheets

SPRAY WAND

FIELD OF THE INVENTION

The present invention relates generally to an extendible spray wand, for spray application of chemical mixtures, such as polyurethane foam.

BACKGROUND

Spray foam insulation has long been used commercially and is increasingly being used in residential construction and renovation projects. It is thought to be much more efficient and effective insulation than fiberglass batts or other similar insulating material.

Spray foam is typically a polyurethane foam produced by reacting an isocyanate containing two or more isocyanate groups per molecule with a polyol containing on average two or more hydroxyl groups per molecule, in the presence of a catalyst or by activation with ultraviolet light. It is applied by delivering the two components in precise ratios and at an elevated temperature to a spray gun under pressure, where the components are mixed in a mixing chamber and immediately expelled in a relatively fine spray. A spray gun system includes two storage tanks for the two chemical components, a pump for each chemical component, and a heater.

If applied incorrectly, the spray foam will fail to cure properly, and may crack, off-gas or cause other problems. Off-gassing produces fumes that are at the very least noxious and potentially toxic. Correct application requires the two components be mixed in the correct ratio and/or at the correct temperature, otherwise these problems can occur. For that reason, spray guns are carefully designed to ensure proper mixing and application.

However, manual operation of a spray gun is limited by the operator's reach, and reaching taller heights and awkward spaces requires ladders, scaffolding or platforms, which introduce safety concerns and cause spray jobs to take a longer time than necessary.

SUMMARY OF INVENTION

In one aspect, the invention may comprise a plural component spray gun system for use with a reactor having a chemical supply, a heater, a pump and a compressor, comprising:

a) a trigger module comprising a spool valve having an air inlet and an activating outlet and an deactivating outlet;

b) an air body connected to the trigger module by an intermediate extending portion and comprising a mixing chamber to combine pressurized chemical components upon activation of a piston by pressure from the activating outlet.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention.

DESCRIPTION OF EMBODIMENTS OF THE INVENTION

The present invention comprises a device used to extend the manual reach of a plural component spray gun. A conventional plural component spray gun combines a trigger mechanism which mixes at least two pressurized chemical streams. The following description is in the context of a polyurethane spray system, which combines a resin component and an isocyanate component, however, it may be adapted to any plural component spray system.

In some embodiments of the present invention, the spray wand comprises a hand-held trigger module (10), and air body (20), and an intermediate extending portion (30) which separates the two. Not shown is the reactor which houses the chemical supply, heaters, pumps and compressors necessary to provide the polyurethane foaming mixture. The reactor may be any conventional reactor.

Figure 1A:
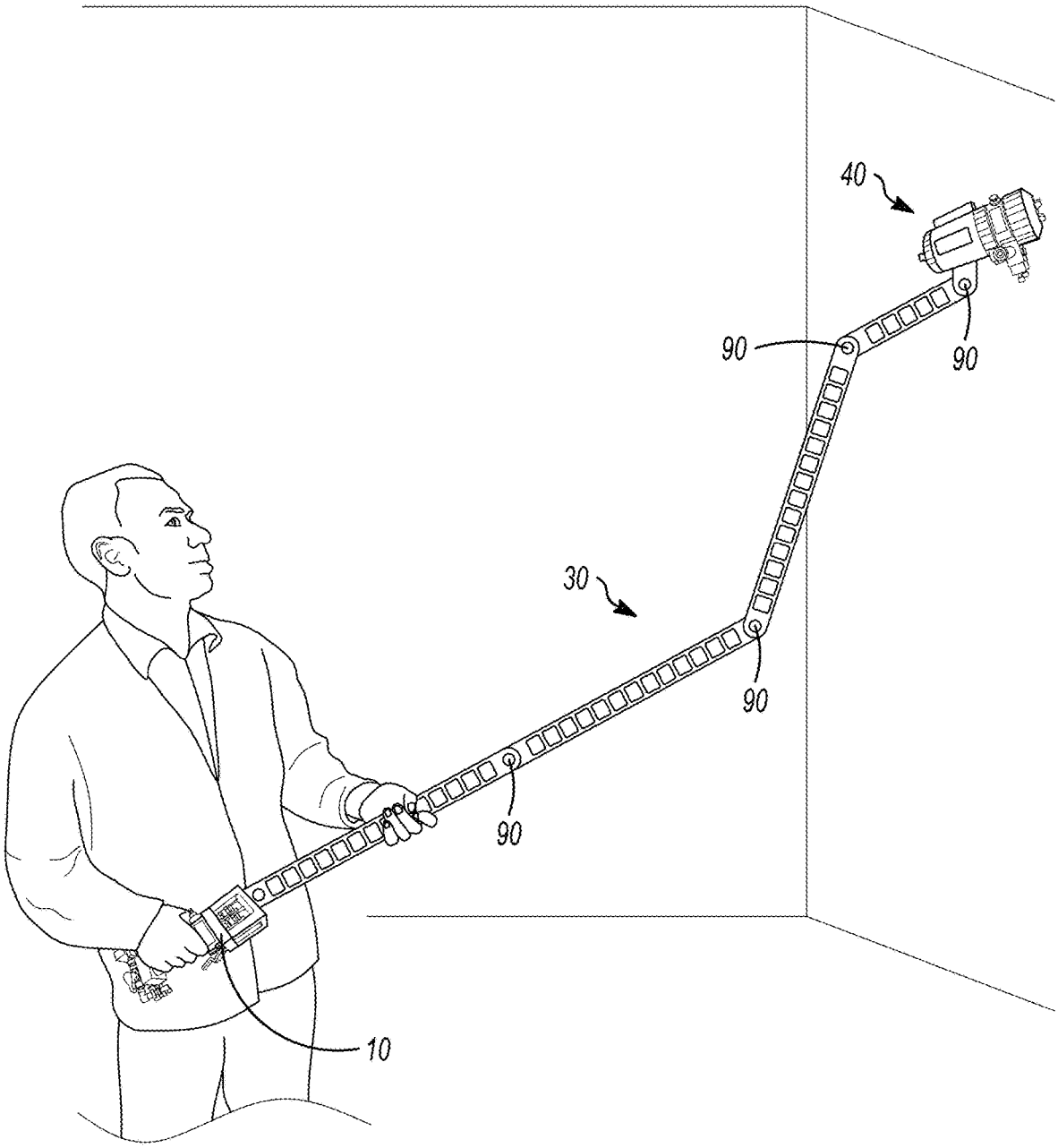
FIG. 1A is a drawing of one embodiment of the present invention in use.
Figure 1B:
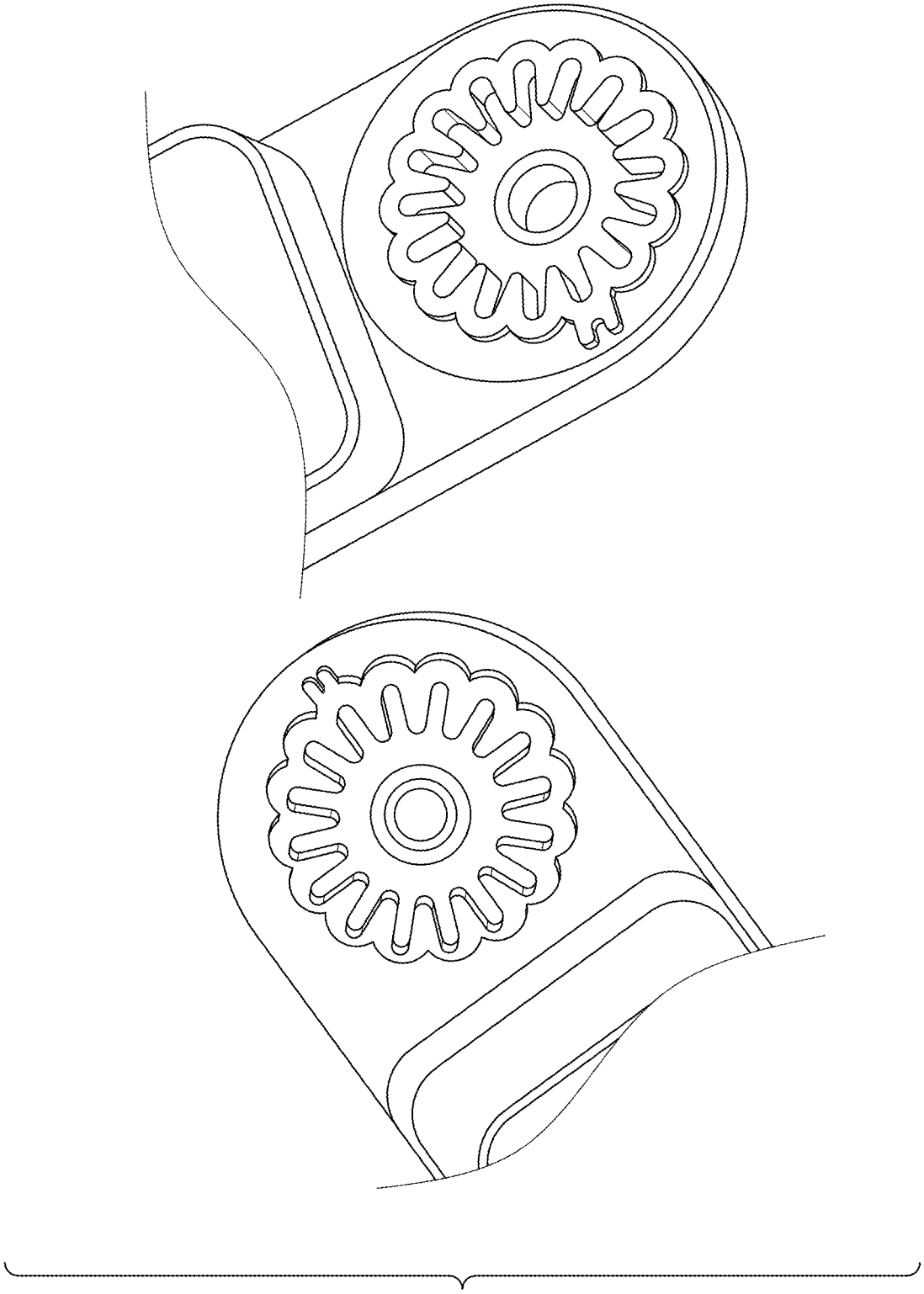
FIG. 1B is a detailed view of one embodiment of a puzzle lock coupling.

The extending portion (30) may comprise one or more extensions which are preferably made of a light weight rigid material, such as aluminum. The extending portion (30) preferably comprises modular, adjustable lengths which can be added and adjusted for length and angle, as shown in FIG. 1A. For example, a kit may combine extensions in two different lengths, each of which may be jointed with each other using a complementary puzzle lock coupling (90), as shown in FIG. 1B. This fit allows for angular adjustment and locked-in positioning.

Figure 2:
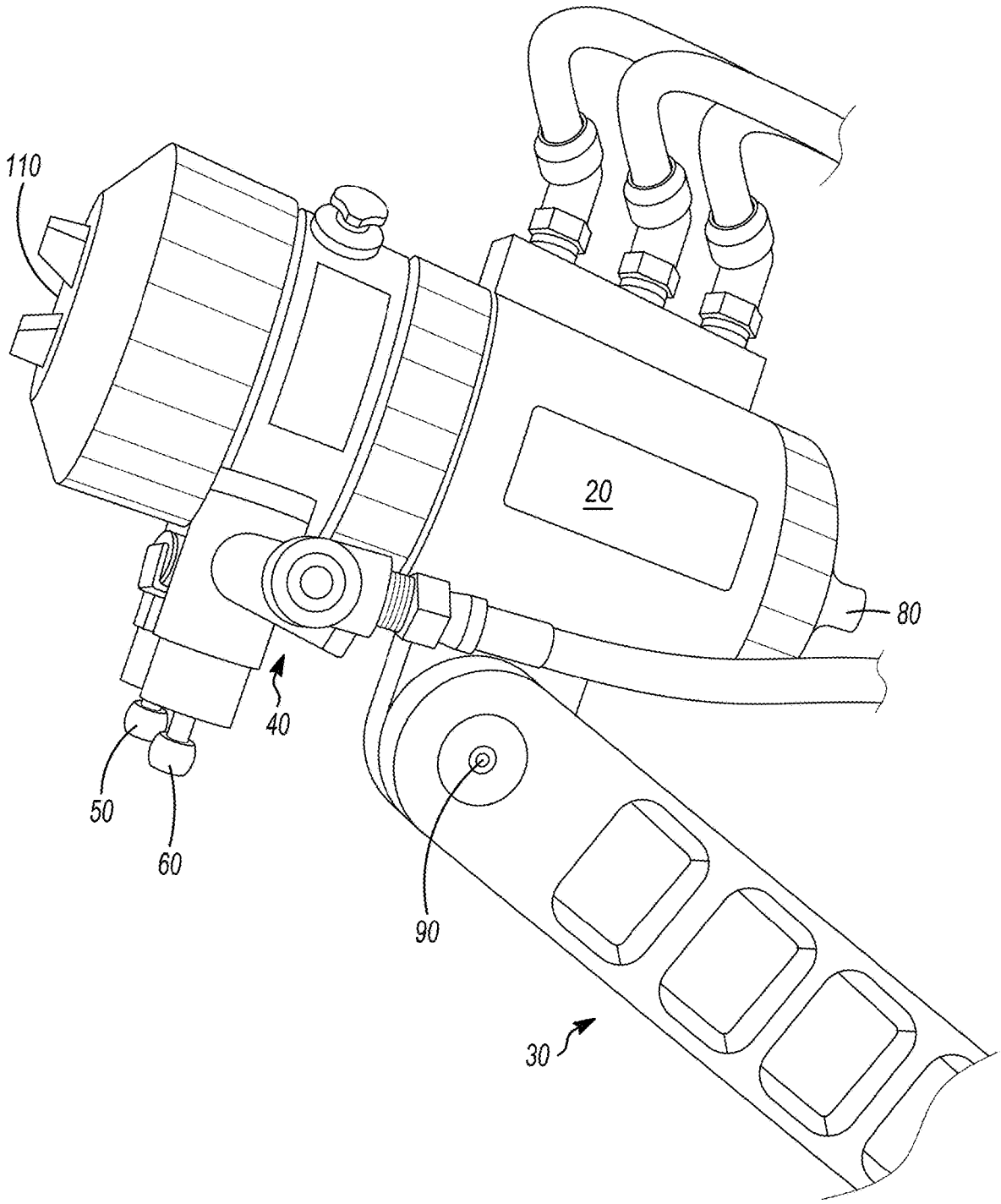
FIG. 2 is a drawing of a spray head on the end of an extension.
Figure 3:
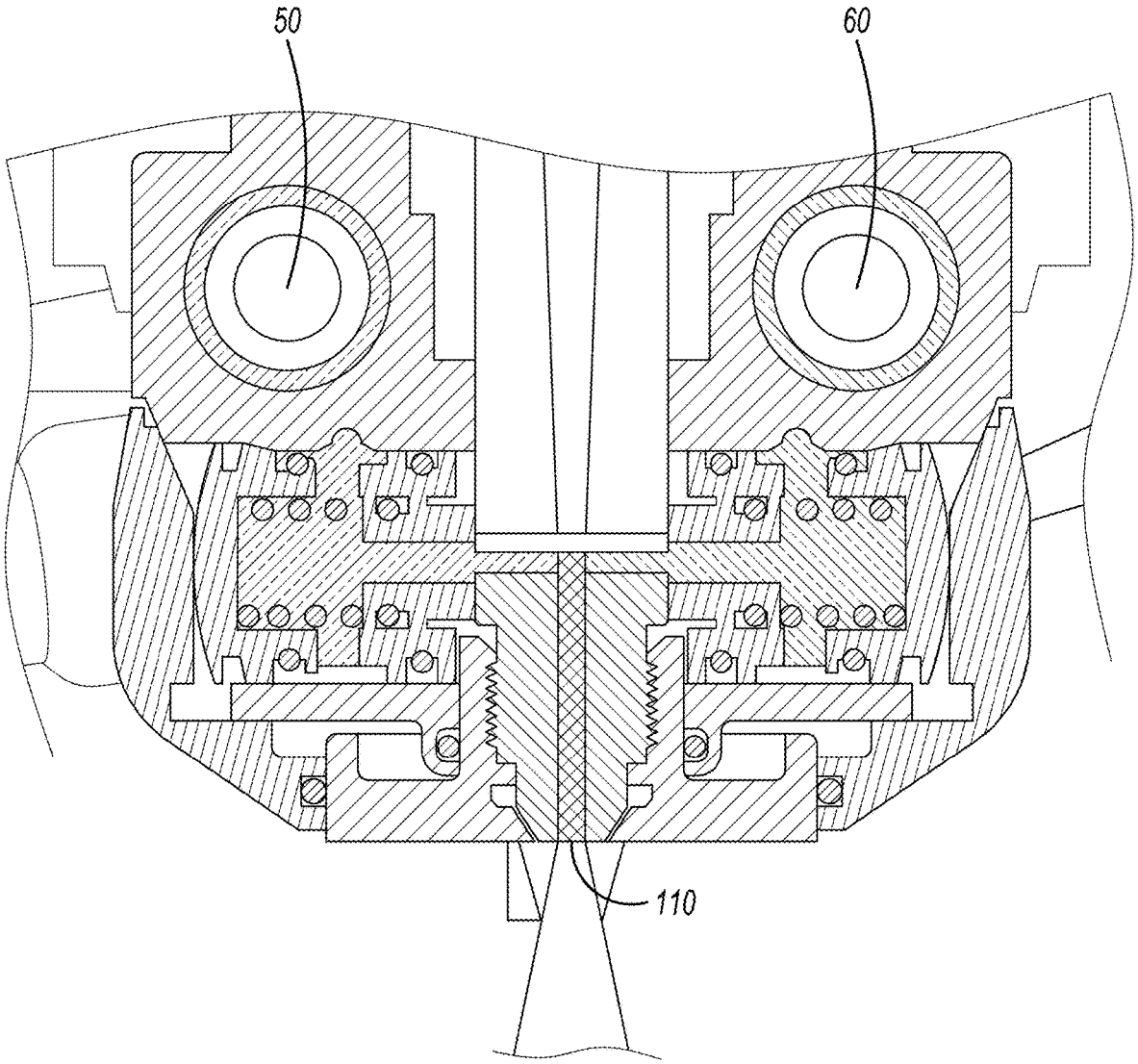
FIG. 3 is a schematic cross-section of the spray head.

As shown in FIG. 2, the air body (20) comprises the spray head (40) disposed on the end extension, using the same puzzle lock coupling (90). The air body (20) comprises a resin coupling (50) and an isocyanate coupling (60) connected to chemical wand hoses (55, 65), and couplings for the three-way air system, described below. As depicted schematically in FIG. 3, the chemical components are drawn into a mixing chamber (100), and outputs a combined spray out the nozzle opening (110). A piston (70) is moveable to trigger the spray, and is disposed in a cylinder (120). A locking screw (80) may be provided to immobilize the piston (70), preventing accidental actuation.

The air body (20) is connected to the far end of the extension with the same puzzle lock coupling (90) as the other joints. The air body (20) is actuated by components in the trigger module (10).

Figure 4:
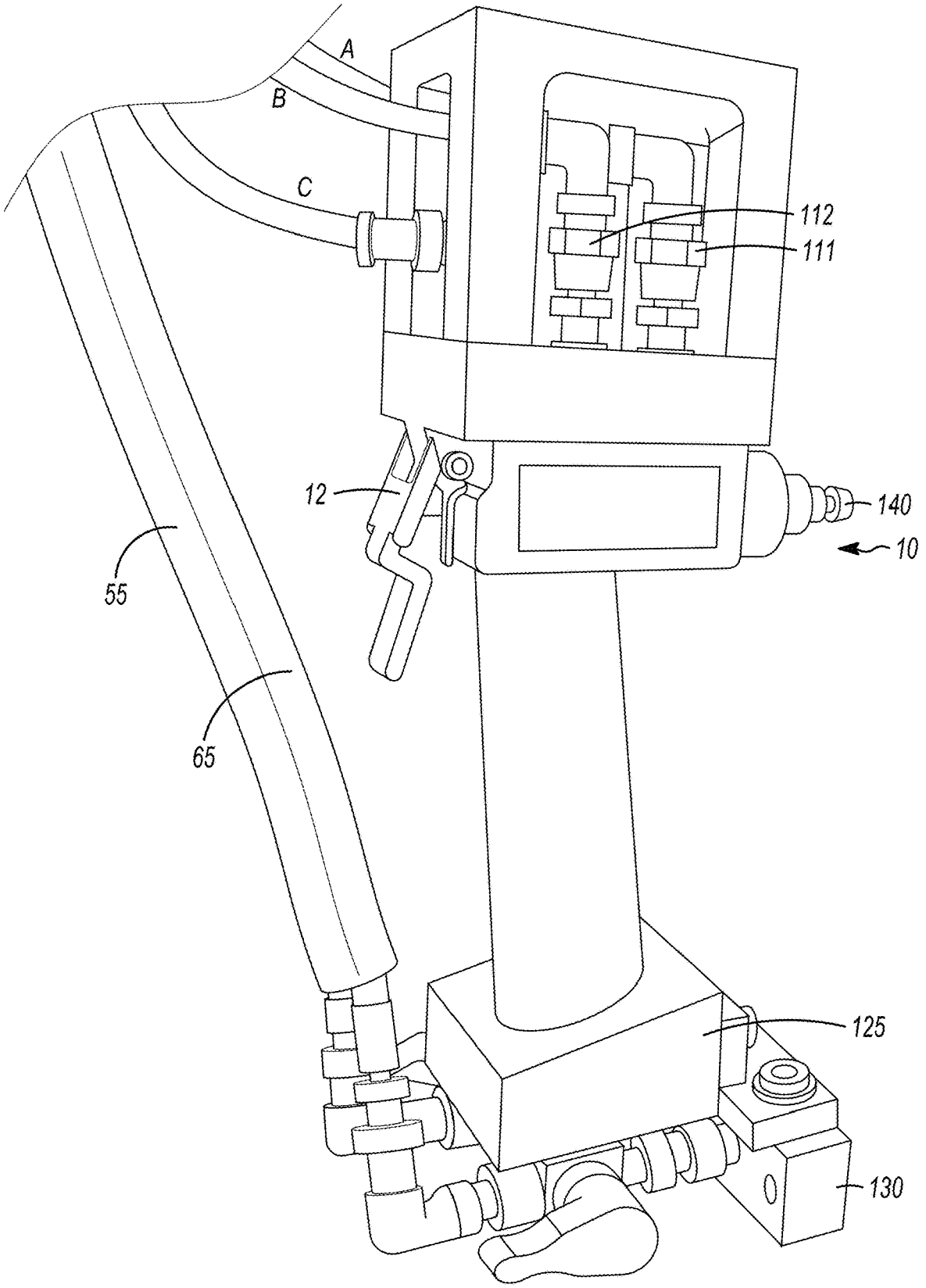
FIG. 4 is a drawing of one embodiment of a trigger module.
Figure 5:
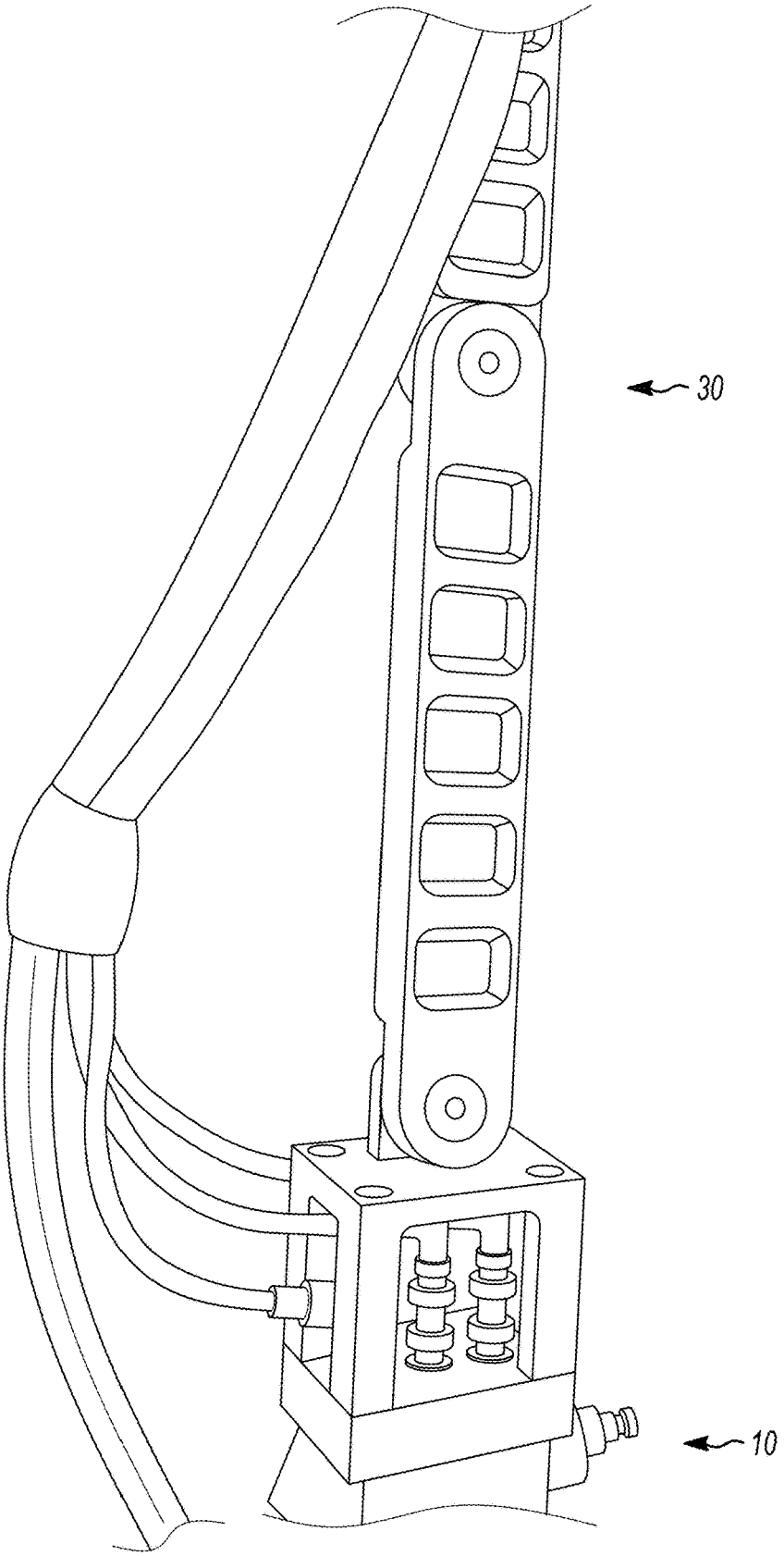
FIG. 5 is a drawing of the top of the trigger module, a first extension, and the hose bundle.

As shown in FIG. 4, the bottom block (125) of the trigger module (10), at the base of the handle, is connected to the hose bundle. The two chemical wand hoses (55, 65) run from the bottom block to the top block located at the base of the fluid head, which is mounted to the air body (20). The bottom block (125) comprises a chemical hose mounting platform (130). The chemicals do not pass through any part of the trigger module (10), but supply hoses attach to couplings on the platform, which connect to the chemical wand hoses (55, 65) leading to the air body (20). A high pressure air inlet (140) connects to a pressurized air supply to provide clean out air and to actuate the piston (70).

Figure 6A:
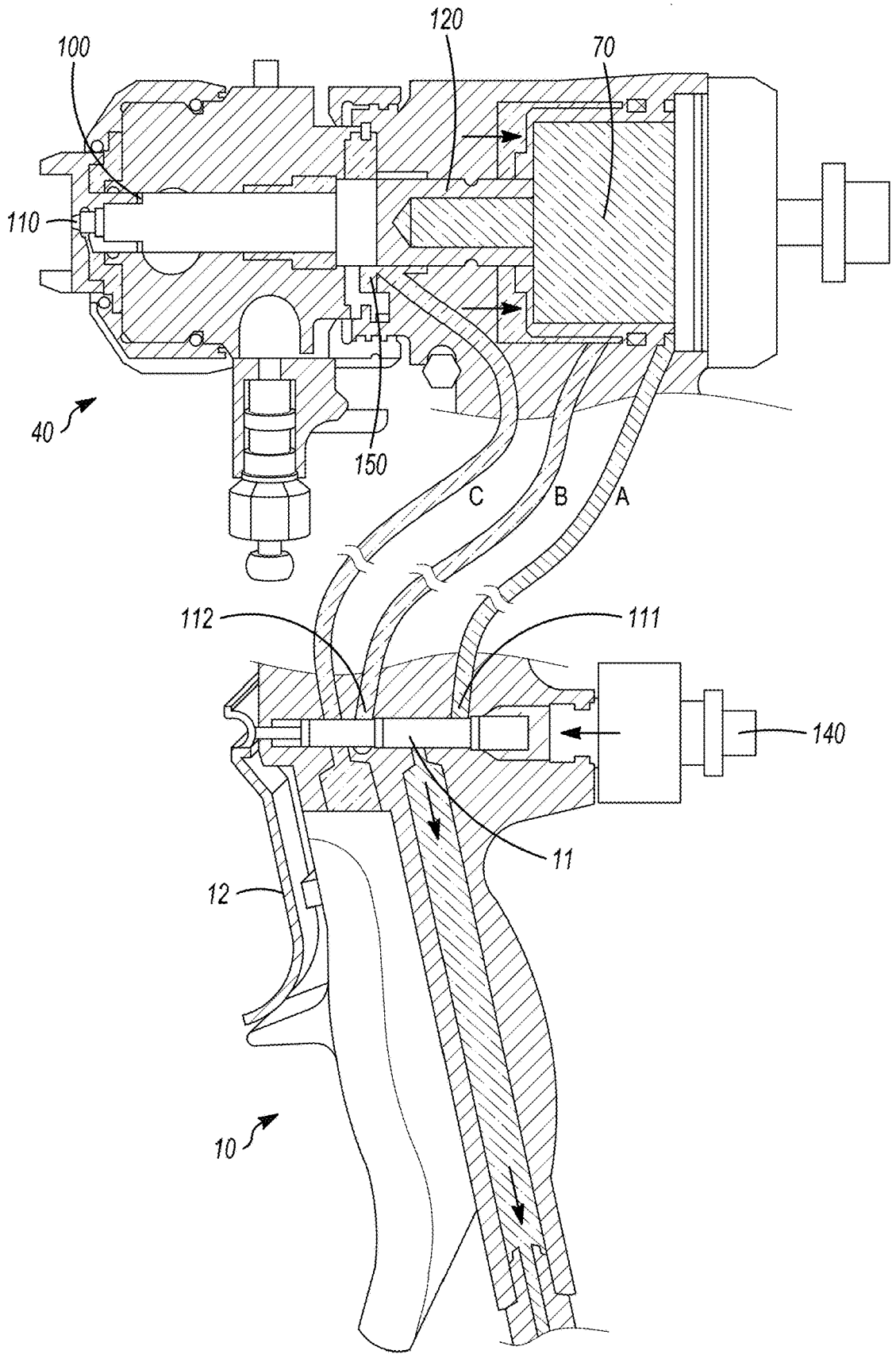
FIG. 6A is a schematic cross-section representation of the spray head and the trigger module, with the spray gun closed.
Figure 6B:
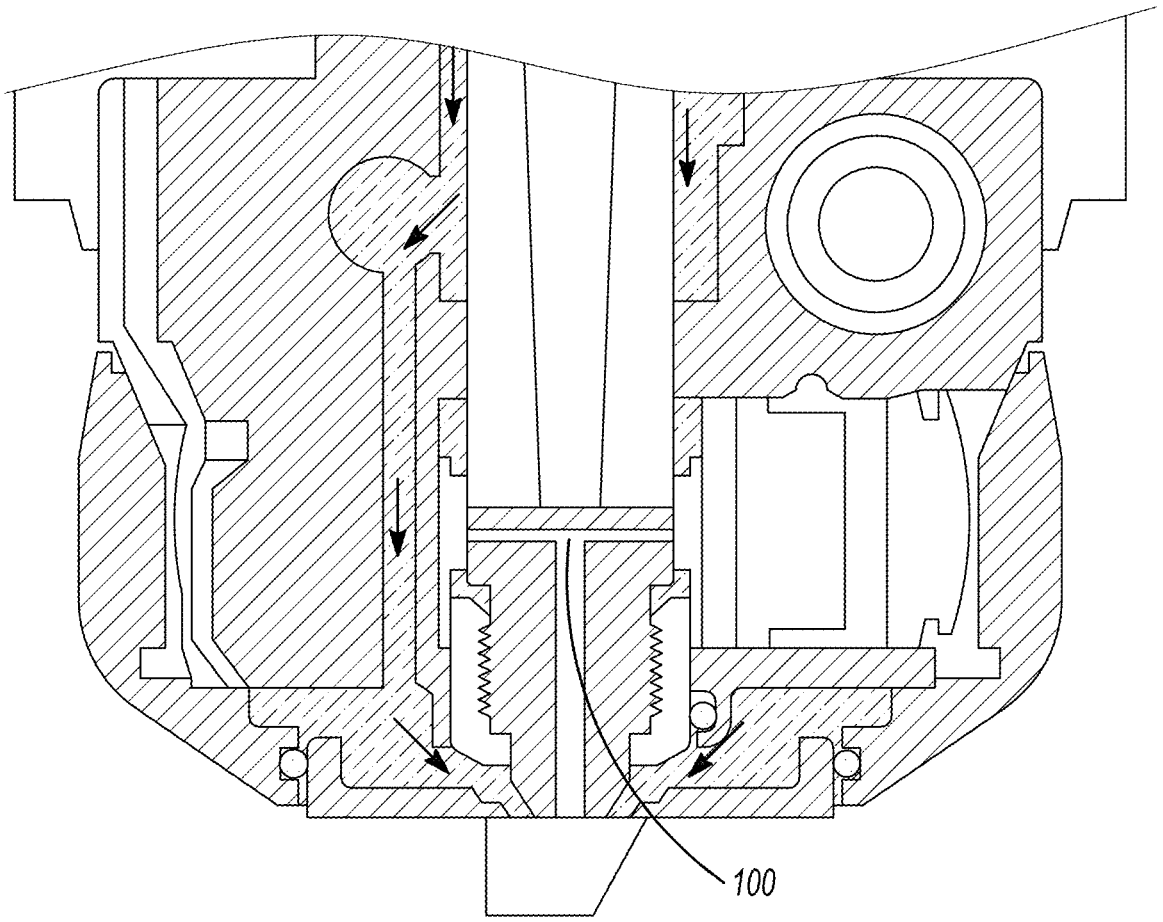
FIG. 6B is a schematic cross-section of the spray head of FIG. 6A.

The trigger module (10) comprises a spool valve (11) which directs the high pressure air through activating outlet (111) and into line A to actuate the piston (70) in the air body (20). Two air lines (A, B) provide air pressure to move the piston (70) back and forth to turn the chemical spray on and off, and a third line (C) provides clean off air, run from the top of the handle to the air body (20), as is shown in FIGS. 6A and 6B. Line A directs air to the trigger side of the piston (70), while Line B directs air to the shutoff side of the piston (70). At rest, as shown in FIG. 6A, high pressure air is directed through deactivating outlet (112) to line B, keeping the piston (70) from actuating the mixing chamber (100) and keeping the spray passages closed.

Figure 7A:
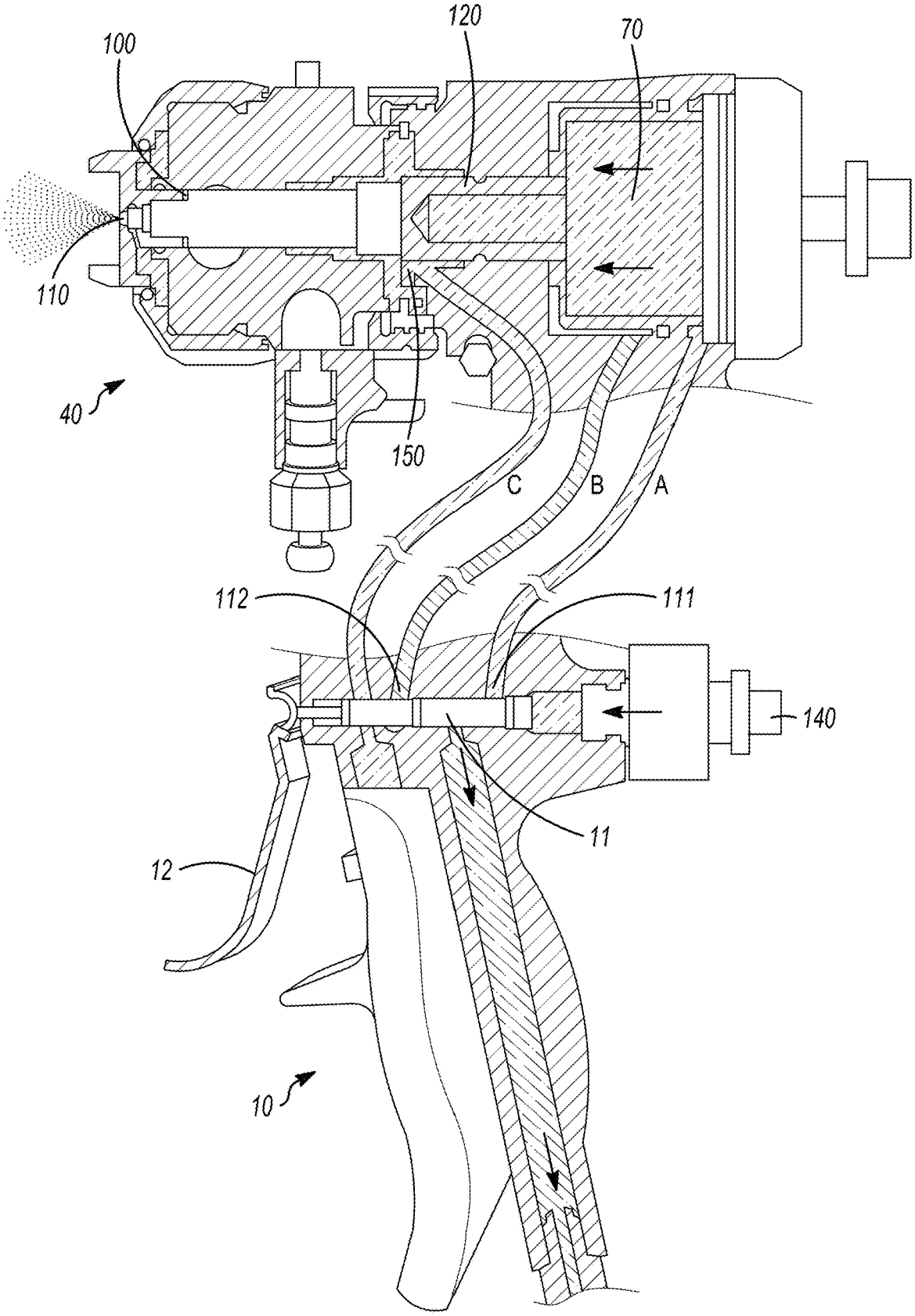
FIG. 7A is a schematic cross-section representation of the spray head and the trigger module, with the spray gun open and spraying.
Figure 7B:
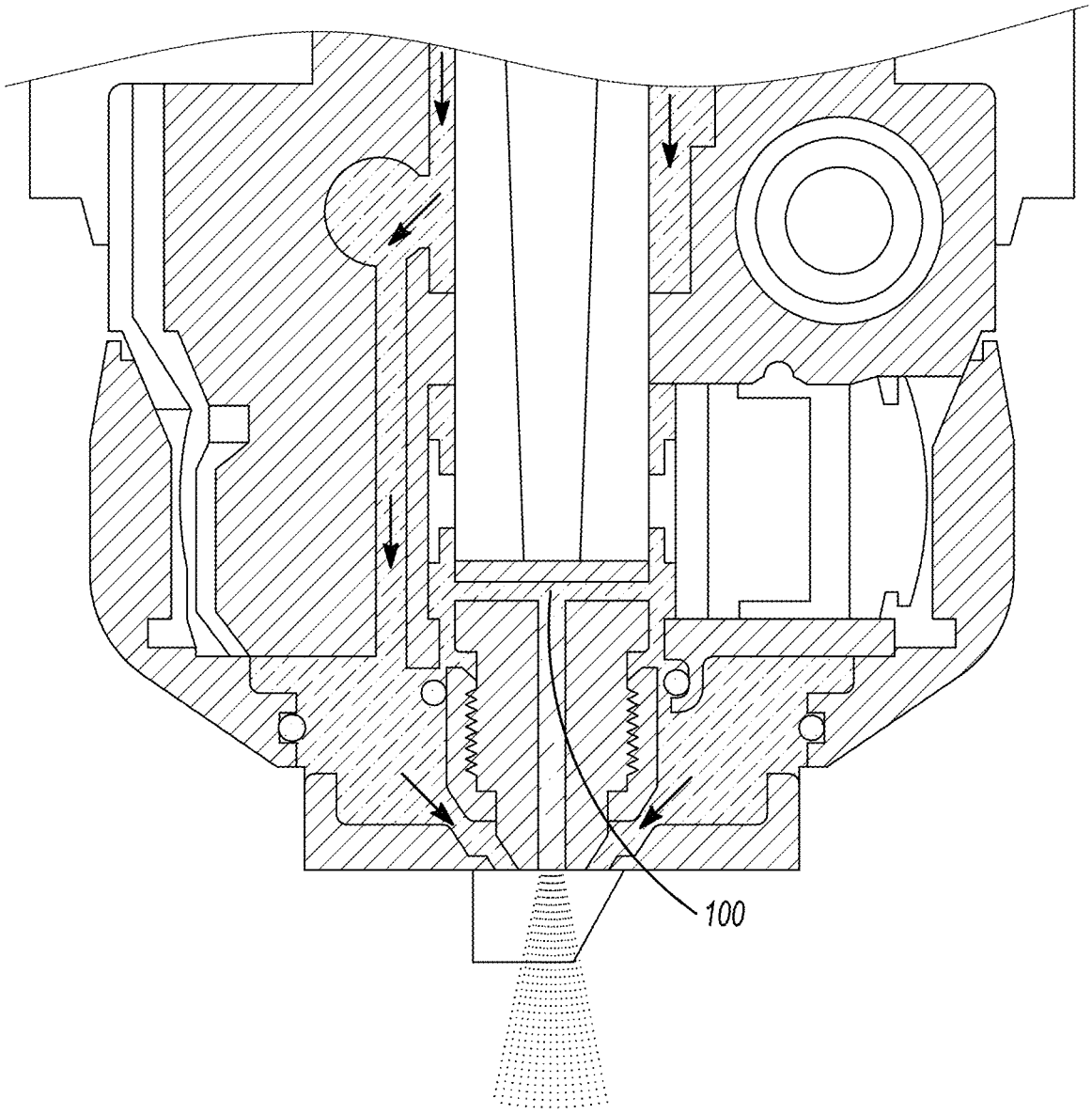
FIG. 7B is a schematic cross-section of the spray head of FIG. 6A.

When the trigger (12) is pulled, it engages the spool valve (11) which switches the high pressure air to line A in turn activates the air body (20), as is shown in FIGS. 7A and 7B, which in turn activates the piston (70). The pressurized chemical components the mixing chamber (100) and spray passages which are key locked, providing a balanced mixture/flow of the 2 fluids.

When spraying is complete, the piston (70) can be locked with the locking screw (80), and the reactor shut down. A clean out air valve (150) on the reactor may then be opened, providing clean out air to the trigger module (10) and the air body (20) when the trigger is pulled.

Definitions and Interpretation

The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. Embodiments were chosen and described in order to best explain the principles of the invention and the practical application, and to enable others of ordinary skill in the art to understand the invention for various embodiments with various modifications as are suited to the particular use contemplated.

The corresponding structures, materials, acts, and equivalents of all means or steps plus function elements in the claims appended to this specification are intended to include any structure, material, or act for performing the function in combination with other claimed elements as specifically claimed.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such aspect, feature, structure, or characteristic with other embodiments, whether or not explicitly described. In other words, any element or feature may be combined with any other element or feature in different embodiments, unless there is an obvious or inherent incompatibility between the two, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated.

As will be understood by the skilled artisan, all numbers, including those expressing quantities of reagents or ingredients, properties such as molecular weight, reaction conditions, and so forth, are approximations and are understood as being optionally modified in all instances by the term "about." These values can vary depending upon the desired properties sought to be obtained by those skilled in the art utilizing the teachings of the descriptions herein. It is also understood that such values inherently contain variability necessarily resulting from the standard deviations found in their respective testing measurements.

The term "about" can refer to a variation off 5%, ±10%, +20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range (e.g., weight percents or carbon groups) includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio. Accordingly, specific values recited for radicals, substituents, and ranges, are for illustration only; they do not exclude other defined values or other values within defined ranges for radicals and substituents.

One skilled in the art will also readily recognize that where members are grouped together in a common manner, such as in a Markush group, the invention encompasses not only the entire group listed as a whole, but each member of the group individually and all possible subgroups of the main group. Additionally, for all purposes, the invention encompasses not only the main group, but also the main group absent one or more of the group members. The invention therefore envisages the explicit exclusion of any one or more of members of a recited group. Accordingly, provisos may apply to any of the disclosed categories or embodiments whereby any one or more of the recited elements, species, or embodiments, may be excluded from such categories or embodiments, for example, as used in an explicit negative limitation.

The invention claimed is:

1. A plural component spray gun system for use with a reactor having a chemical supply, a heater, a pump and a compressor, comprising:

a) a trigger module comprising a spool valve having an air inlet and an activating outlet and an deactivating outlet;

b) an air body comprising a mixing chamber to combine pressurized chemical components upon activation of a piston by pressure from the activating outlet; and c) an elongate intermediate extending portion, wherein the trigger module and air body are connected to different ends of the intermediate extending portion such that the trigger module and air body are separate from each other.

2. The system of claim 1 wherein the intermediate extending portion comprises a plurality of interconnecting extensions which may be adjusted in angle relative to each other and locked together at a desired angle relative to each other.

3. The system of claim 1 wherein the air body may be adjusted in angle relative to the intermediate extending portion, and locked at a desired angle relative to the intermediate extending portion.

4. The system of claim 1 further comprising a first line connecting the activating outlet to the air body to activate the piston, and a second line connecting the deactivating outlet to the air body to deactivate the piston.

* * * * *